United States Patent [19]

Cotton

[11] 3,958,424

[45] May 25, 1976

[54] LIQUID LIFTING AND STORAGE APPARATUS AND METHOD

[75] Inventor: Boyce Y. Cotton, Sanford, N.C.

[73] Assignee: Horace P. Cotton, Roanoke, Va.

[22] Filed: Jan. 15, 1974

[21] Appl. No.: 433,470

[52] U.S. Cl. ..... 61/10; 47/38.1; 47/41.13

[51] Int. Cl.[2] ..... E02B 13/00

[58] Field of Search ..... 220/20, 22; 138/43; 61/10, 13; 52/310; 415/71; 47/41.13, 38.1

[56] References Cited

UNITED STATES PATENTS

| | | | |
|---|---|---|---|
| 2,810,286 | 10/1957 | Barnhart | 52/310 |
| 3,797,250 | 3/1974 | Canevari | 61/35 |

FOREIGN PATENTS OR APPLICATIONS

| | | | |
|---|---|---|---|
| 1,168,485 | 12/1958 | France | 47/38.10 |
| 603,978 | 8/1932 | Germany | 47/38.10 |

*Primary Examiner*—Paul R. Gilliam
*Assistant Examiner*—Alex Grosz
*Attorney, Agent, or Firm*—Mason, Fenwick & Lawrence

[57] ABSTRACT

A continuous outwardly spiralling vertically oriented web of glass or similar material is disclosed extending between a central core cylinder and a larger coaxial outer peripheral cylinder with adjacent convolutions of the web equidistantly spaced sufficiently close to each other to provide capillary attraction for liquid engaging lower portions of the web to lift and maintain the liquid above its normal level.

3 Claims, 4 Drawing Figures

Fig-1
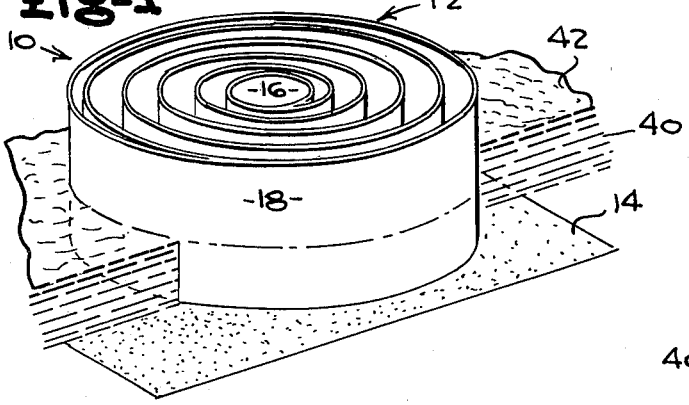
Fig4
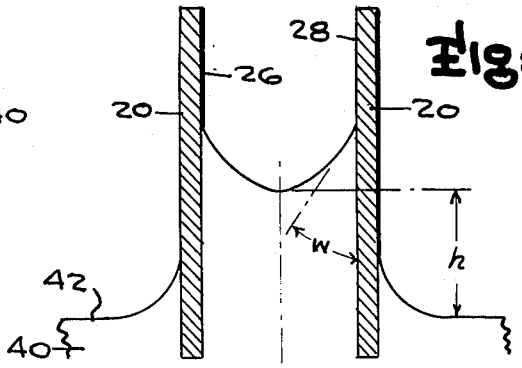
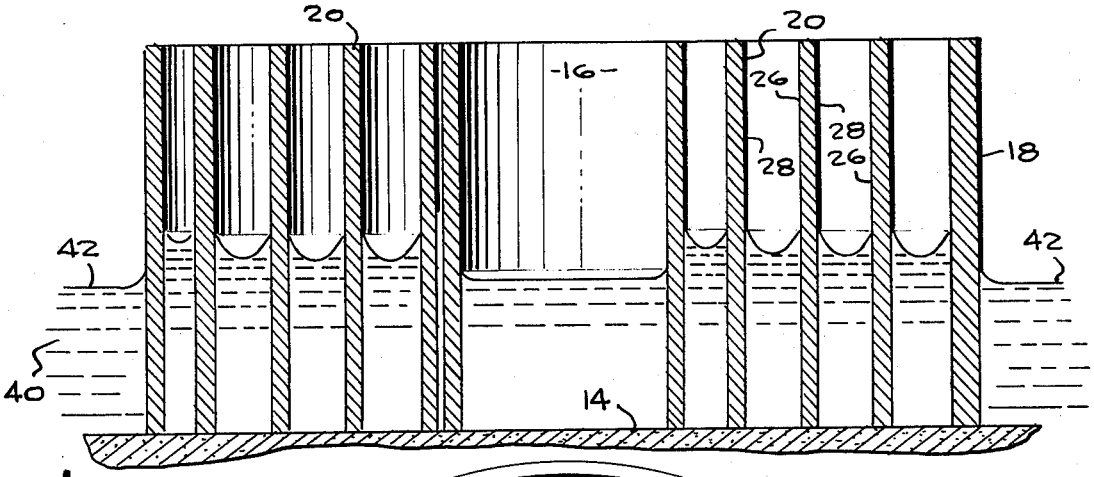
Fig-3
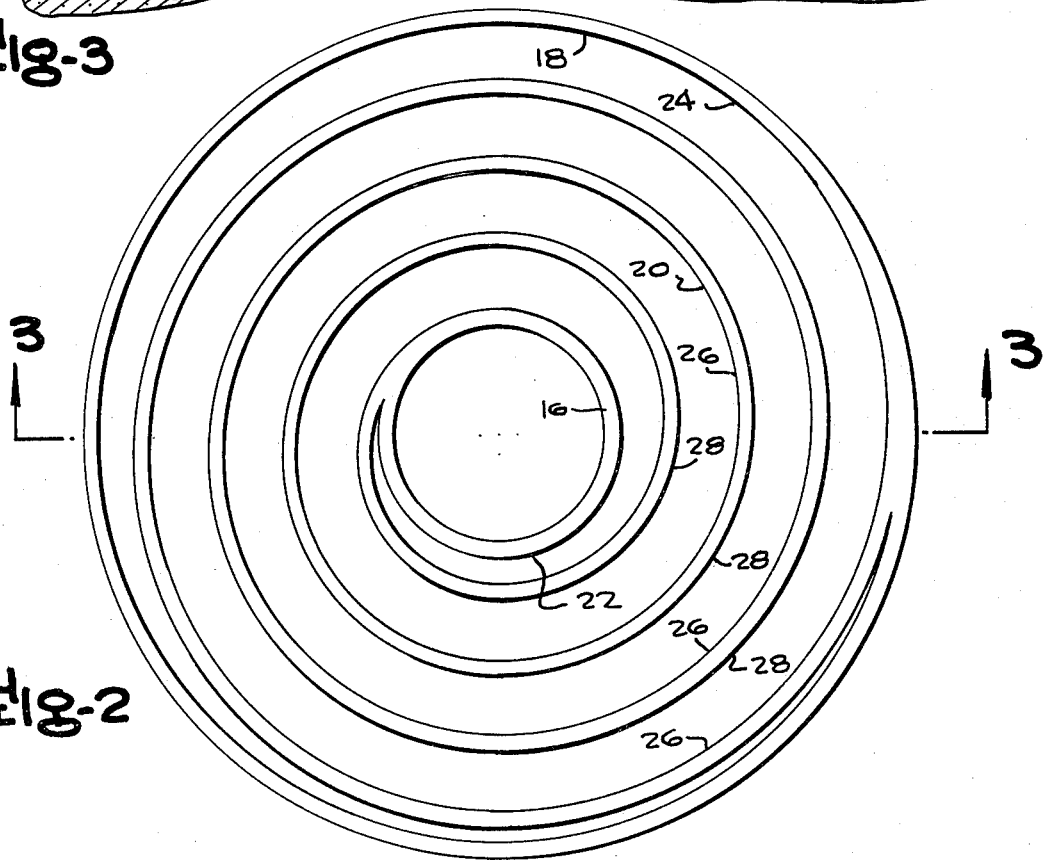
Fig-2

LIQUID LIFTING AND STORAGE APPARATUS AND METHOD

This invention is in the field of liquid lifting and storage devices and is specifically directed to a uniquely simple device capable of lifting and retaining large quantities of water without the employment of an external power source.

Even more specifically, the subject invention is directed to water storage means capable of usage in storing and retaining water for irrigation or other purposes.

Moisture in cultivated fields, orchards and the like is largely dissipated by absorption into the earth and/or evaporation. Consequently, such moisture, whether resultant from natural rainfall or from intentional irrigation practices, is largely lost and of no benefit to the growing process. Consequently, expedients such as covering the soil with plastic sheets for retarding evaporation has been employed in an effort to lessen the water loss; however, such expedients, while quite effective in retarding evaporation, do not in any way impede the losses occasioned by seepage of ground water to lower levels and vast quantities of water consequently to be lost by such seepage.

A great amount of rainfall is lost due to the fact that during any substantial rainfall, the soil soon becomes saturated and subsequent rainfall is lost by the runoff of such into ditches, streams and the like with impoundment in ponds or lakes being the only way in which such runoff water can be salvaged.

Therefore, it is the primary object of this invention to provide new and improved methods and apparatus for lifting and retaining ground water in agricultural and other environments.

Yet another object of the subject invention is the provision of new and improved liquid lifting and storing means.

Yet another object of the subject invention is the provision of means capable of lifting water above a given level without the employment of power driven means.

A further object of this invention is the lowering of water losses due to runoff of surface water.

Achievement of the foregoing objects is enabled by the preferred embodiment of the invention in a remarkably simple and efficient manner which requires no power for control or operation and which requires minimum maintenance.

Specifically, the preferred embodiment of the invention comprises a planar horizontal flat supporting base of brick, sand, concrete or tile normally embedded below ground level providing support for a lifting and storing unit consisting of one or more vertically oriented webs of glass or the like formed in a spiral consisting of a plurality of equidistantly closely space adjacent convolutions. Adjacent convolutions are closely spaced together so that the capillary effect between adjacent faces of the convolutions serves to lift water upwardly between the convolutions to a height above its normal level determined by the spacing of the convolutions and the material from which they are formed. The inner extent of the lifting and storing unit consists of a central core cylinder and the outer extent consists of a peripheral cylinder coaxial with the core cylinder with the spiral web or webs extending between the outer surface of the central core cylinder and the inner surface of the outer peripheral cylinder. The inner core cylinder and the outer peripheral cylinder are unitarily formed with the spiral web or webs and can be of a number of desired materials having a low wetting angle such as glass, ceramic material or the like. Additionally, plastic or artificial material such as nylon can also be employed for forming the cylinders and the spiral web members.

It should be appreciated that the amount of liquid capable of being lifted and stored by the spiral web or webs of the preferred embodiment is limited solely by the size of the preferred embodiment which can be increased or decreased in accordance with the particular usage of the device. When the lifting and storing device is used in a field, a plurality of the devices would be located at spaced intervals in the field for receiving and storing ground water as well as any rainfall that might occur. Consequently, the water will be lifted to a higher level than would normally be the case and will be restrained from seeping away below the lowermost cultivated level of the particular field in which the devices are used.

A better understanding of the manner in which the preferred embodiment accomplishes the foregoing objects will be enabled when the following detailed description is considered in conjunction with the appended drawings in which:

FIG. 1 is a perspective view of the preferred embodiment;

FIG. 2 is a top plan view of the preferred embodiment;

FIG. 3 is a sectional view taken along lines 3—3 of FIG. 2; and

FIG. 4 is an enlarged view of two adjacent convolutions of the spiral web member of FIG. 3.

Attention is initially invited to FIG. 1 of the drawings which illustrates the preferred embodiment, generally designated 10, which comprises a liquid lifting and storing unit 12, and a base support 14.

Base support 14 has a planar upper surface and can comprise a concrete slab, a tile or brick bed or similar construction. The liquid lifting and storing unit 12 merely rests on the base support means 14 for a purpose which will become apparent hereinafter.

The liquid lifting and storing unit 12 comprises a central core cylinder 16, an outer peripheral cylinder 18 and one or more webs 20 extending between the outer surface 22 of the central core cylinder 16 and the inner surface 24 of the outer peripheral cylinder 18. If plural webs should be employed, they would be equidistantly spaced with respect to each other.

Liquid lifting and storing unit 12 can be formed of glass, porcelainized steel, fired vitreous material, ceramic material or the like having a low wetting angle. Moreover, the liquid lifting and storing unit 12 can also be formed of metal or other suitable material having a permanent coating of material having the necessary low wetting angle.

Web 20 is arranged in a spiral configuration in which the adjacent convolutions are equidistantly spaced a small distance apart. Web 20 has a first surface 26 and a second surface 28 with the arrangement being such that the first surface 26 faces the second surface 28 of an adjacent convolution with the closely spaced surfaces 26 and 28 serving to provide capillary attraction for water to be lifted and stored in a manner to be discussed.

The lower portion of the liquid lifting and storing unit 12 is immersed in a body of liquid 40 having an upper surface 42 either above or below ground level depending upon the circumstances. The closely spaced surfaces 26 and 28 of adjacent convolutions serve to lift the water by an amount h which varies in accordance with several parameters including the cosine of the wetting angle W (FIG. 4) and the spacing between the adjacent convolutions. The physical laws controlling the lifting of the liquid are well-known and can be easily calculated. It is consequently a simple matter to calculate the height h of lifted and stored water as well as the total volume of water lifted. When lifted to height h, the stored water possesses an hydraulic head capable of doing work.

In operation, when a plurality of the units 12, 14 etc. are spaced in an area such as a cultivated field, rain water falling into the open top of the device will be retained by the surface tension to be dispensed outwardly, doing work, from the bottom of the device as the water level in the soil falls. Similarly, positioning of the lifting and storing unit 12 in a field having a body of surface or subsurface water 40 would serve to lift a portion of the water upwardly to store same for subsequent dispensing from the bottom of the device.

Therefore, it will be appreciated that the subject device represents a substantial advance in the storing and dispensing of water having particular advantages in agricultural irrigation and other endeavors. Moreover, while numerous modifications of the subject invention as exemplified by the preferred embodiment will undoubtedly occur to those of skill in the art, it should be strictly understood that the spirit and scope of the invention is to be limited solely by the appended claims.

I claim:

1. A liquid lifting and storing system for irrigation purposes comprising a base support member embedded in the earth and having an upper surface below the soil level of its immediate surroundings and a liquid lifting and storing unit having a lower end resting upon said upper surface of said base support member, said lifting and storing unit including a vertically extending axial cylindrical central core having an outer surface, an outer peripheral cylinder member having an inner surface coaxially positioned with respect to said central core and a spiral web means extending in equidistantly spaced continuous uninterrupted convolutions about a vertical axis between the outer surface of said cylindrical central core and the inner surface of said outer peripheral cylindrical member with said web means having opposite surfaces facing each other in adjacent convolutions to define closely spaced vertically extending wall surfaces to provide a capillary action on liquid occupying the space between said wall surfaces, whereby ground water surrounding said base support member and having an upper level above the upper surface of said base support member seepingly moves between the lower end of said lifting and storing unit over the upper surface of said base member to occupy the space between the lower portions of said opposite surfaces of said web means and said capillary action lifts said water above the upper level of the ground water with water in said lifting and storing unit being released to flow in a reverse direction back into the surrounding earth as the upper level of the ground water falls.

2. The invention of claim 1 wherein said liquid lifting and storing unit is unitarily formed of glass.

3. The invention of claim 1 wherein said spiral web is formed of glass.

* * * * *